US010461457B1

(12) United States Patent
Aono

(10) Patent No.: US 10,461,457 B1
(45) Date of Patent: Oct. 29, 2019

(54) CONNECTOR HOUSING AND TERMINAL POSITION ASSURANCE JOINT CLIP SITE

(71) Applicant: YAZAKI NORTH AMERICA, INC., Canton, MI (US)

(72) Inventor: Michikazu Aono, Milan, MI (US)

(73) Assignee: YAZAKI NORTH AMERICA, INC., Canton, MI (US)

( * ) Notice: Subject to any disclaimer, the term of this patent is extended or adjusted under 35 U.S.C. 154(b) by 0 days.

(21) Appl. No.: 16/042,647

(22) Filed: Jul. 23, 2018

(51) Int. Cl.
*H01R 13/422* (2006.01)
*H01R 13/426* (2006.01)

(52) U.S. Cl.
CPC ..... *H01R 13/426* (2013.01); *H01R 13/422* (2013.01)

(58) Field of Classification Search
CPC ..... H01R 13/4362; H01R 13/4367; H01R 13/4223
USPC ..... 439/752, 595
See application file for complete search history.

(56) References Cited

U.S. PATENT DOCUMENTS 6,361,379 B1 * 3/2002 Ito ..... H01R 13/4223 439/692
7,048,581 B1 * 5/2006 Wong ..... H01R 13/426 439/595
7,347,742 B2 3/2008 Hall et al.
7,534,134 B2 * 5/2009 Qiu ..... H01R 13/73 439/527
7,682,205 B2 * 3/2010 Hall ..... H01R 13/4361 439/752
8,336,196 B2 * 12/2012 Goto ..... H01R 43/20 29/736
8,678,866 B2 * 3/2014 Hiraishi ..... H01R 13/4365 439/595
2007/0054535 A1 * 3/2007 Hall ..... H01R 13/6272 439/352

* cited by examiner

*Primary Examiner* — Hien D Vu
(74) *Attorney, Agent, or Firm* — RMCK Law Group, PLC

(57) ABSTRACT

An electrical connector assembly comprises a housing, a terminal position assurance (TPA) member, and a slide clip. The housing can comprise (i) at least one terminal insertion cavity for receiving an electrical terminal, (ii) a primary locking member that engages with the electrical terminal to retain the electrical terminal therein, (iii) a slide clip receiver, and (iv) a plurality of latching members. The TPA member can couple with the housing. The slide clip can couple with the housing via the slide clip receiver. In an assembled condition, the electrical terminal can retained within the at least one terminal insertion cavity by the primary locking member, the TPA member can inhibit movement of the primary locking member, and the slide clip can be coupled with the slide clip receiver such that the TPA member is constrained between the housing and the slide clip to inhibit disengagement of the TPA member.

19 Claims, 6 Drawing Sheets

CONNECTOR HOUSING AND TERMINAL POSITION ASSURANCE JOINT CLIP SITE

FIELD

The present disclosure relates to electrical connectors and, more particularly, to an improved connector assembly that provides for ease of assembly and a reduced number of components while maintaining an assembled condition.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Conventional electrical connector assemblies typically include one or more housings, wherein each of which has one or more openings for receiving a corresponding electrical terminal. An electrical terminal is inserted and fixedly secured within each opening. The housings may be coupled together to mate and electrically couple their electrical terminals. In order to provide a secure coupling of the electrical terminals and the housings, conventional electrical connector assemblies may incorporate a large number of locking features and/or extra components. Each additional component may increase the size of the electrical connector assembly, while also increasing the manufacturing and assembly complexity of the device. While it is important to provide a secure coupling of electrical terminals, it may also be desirable to provide such a secure coupling with a reduced number of components and smaller size.

SUMMARY

In various embodiments of the present disclosure, an electrical connector assembly is disclosed. The electrical connector assembly comprises a housing, a terminal position assurance (TPA) member, and a slide clip. The housing can comprise (i) at least one terminal insertion cavity for receiving an electrical terminal, (ii) a primary locking member that engages with the electrical terminal when the electrical terminal is inserted within the at least one terminal insertion cavity to retain the electrical terminal therein, (iii) a slide clip receiver, and (iv) a plurality of latching members. The TPA member can couple with the housing via the plurality of latching members. The TPA member can be U-shaped and include a bottom wall and two side walls extending from the bottom wall. Each of the two side walls can have a connecting portion configured to mate with at least one of the plurality of latching members. The slide clip can couple with the housing via the slide clip receiver. In an assembled condition, the electrical terminal can retained within the at least one terminal insertion cavity by the primary locking member in an engaged condition. Further, the TPA member can be fixedly coupled to the housing via the plurality of latching members cooperating with the connecting portions. The plurality of latching members can inhibit movement of the TPA member in a disengagement direction. The TPA member can also inhibit movement of the primary locking member from the engaged condition. The slide clip can be coupled with the slide clip receiver such that the TPA member is constrained between the housing and the slide clip to inhibit movement of the TPA member in the disengagement direction.

In additional embodiments of the present disclosure, an electrical connector assembly is disclosed. The electrical connector assembly can include a first electrical terminal, a second electrical terminal, a first housing, a second housing, a first terminal position assurance (TPA) member, a second terminal position assurance (TPA) member, a first slide clip, and a second slide clip. The first housing can comprise (i) at least one first terminal insertion cavity for receiving the first electrical terminal, (ii) a first primary locking member that engages with the first electrical terminal when the first electrical terminal is inserted within the at least one first terminal insertion cavity to retain the first electrical terminal within the at least one first terminal insertion cavity, (iii) a first slide clip receiver, and (iv) a plurality of first latching members. The second housing can comprise (i) at least one second terminal insertion cavity for receiving the second electrical terminal, (ii) a second primary locking member that engages with the second electrical terminal when the second electrical terminal is inserted within the at least one second terminal insertion cavity to retain the second electrical terminal within the at least one second terminal insertion cavity, (iii) a second slide clip receiver, and (iv) a plurality of second latching members.

The first terminal position assurance (TPA) member can couplewith the first housing via the plurality of first latching members. The first TPA member can have a U-shape and include a bottom wall and two side walls extending from the bottom wall. Each of the two side walls can have a first connecting portion configured to mate with at least one of the plurality of first latching members. Similarly, the second terminal position assurance (TPA) member can couple with the second housing via the plurality of second latching members. The second TPA member can have a U-shape and include a bottom wall and two side walls extending from the bottom wall, where each of the two side walls has a second connecting portion configured to mate with at least one of the plurality of second latching members. The first slide clip can couple with the first housing via the first slide clip receiver and the second slide clip can couple with the second housing via the second slide clip receiver.

In the assembled condition, the first electrical terminal can be retained within the at least one first terminal insertion cavity by the first primary locking member in an engaged condition, and the second electrical terminal can be retained within the at least one second terminal insertion cavity by the second primary locking member in an engaged condition. The first TPA member can be fixedly coupled to the first housing via the plurality of first latching members cooperating with the first connecting portions and the second TPA member can be fixedly coupled to the second housing via the plurality of second latching members cooperating with the second connecting portions. The plurality of first latching members can inhibit movement of the first TPA member in a disengagement direction and the plurality of second latching members can inhibit movement of the second TPA member in the disengagement direction. The first TPA member can also inhibit movement of the first primary locking member from the engaged condition and the second TPA member can inhibit movement of the second primary locking member from the engaged condition.

The first slide clip can coupled with the first slide clip receiver such that the first TPA member is constrained between the first housing and the first slide clip to inhibit movement of the first TPA member in the disengagement direction. Additionally, the second slide clip is coupled with the second slide clip receiver such that the second TPA member is constrained between the second housing and the second slide clip to inhibit movement of the second TPA member in the disengagement direction. The first housing can be coupled with the second housing such that the first electrical terminal is coupled with the second electrical terminal.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
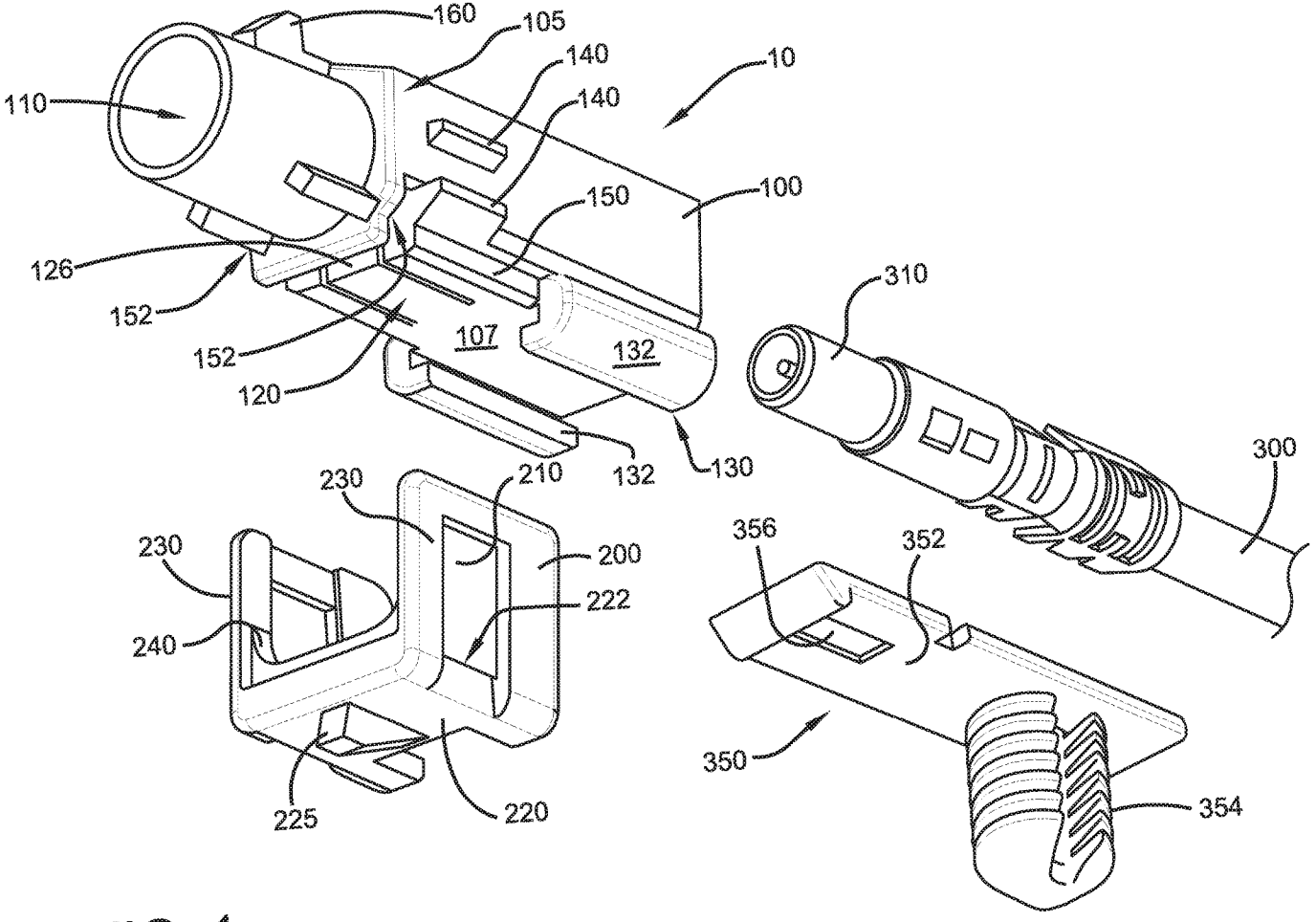
FIG. 1 is a perspective view of an example electrical connector assembly according to some implementations of the present disclosure.

As previously discussed, conventional electrical connector assemblies typically include one or more housings that can be mated to effect a coupling of electrical terminals carried therein. Each of the housings may fixedly secure the electrical terminals with a locking feature that acts to retain the electrical terminal within the housing. In some cases, a secondary locking feature in the form of an additional component to be mated with the housing can be utilized to provide a secondary or back-up locking functionality when fully assembled. Further, a clip or other mechanism for mounting the housing(s) to a rigid member (such as a body panel of a vehicle) can be coupled to the housing(s) or otherwise provided.

There are a number of disadvantages associated with the conventional electrical connector assemblies briefly described above. For example, in order to provide the primary and secondary locking functionality, additional features on the components and/or additional components may be required. These additional features/components can add to the cost of manufacture, increase the complexity of assembly, and/or increase the size of the connector assembly. Additionally, many of these additional features/components are added to the housing(s) in a clunky manner such that the resulting electrical connector assembly is bulky and prone to failure in operation as the features/components operate independently.

In order to address the above described and other problems with conventional electrical connector assemblies, an improved electrical connector assembly is disclosed. The electrical connector assembly can include a housing, a terminal position assurance (TPA) member, and a slide clip. The housing can include at least one terminal insertion cavity for receiving an electrical terminal. A primary locking member can be provided on the housing and can engage with the electrical terminal when the electrical terminal is inserted within the insertion cavity. The primary locking member can retain the electrical terminal within the insertion cavity. For example only, the primary locking member can take the form of a flexible retention arm that includes a ramp and a locking surface. The electrical terminal can flex the retention arm by acting on the ramp during insertion of the electrical terminal into the cavity. Upon being fully inserted, the retention arm can return to its un-flexed position ("engaged condition") and the locking surface can cooperate with a corresponding feature on the electrical terminal to inhibit removal of the electrical terminal from the cavity.

A plurality of latching members can extend outwardly from an outside surface of the housing and interact with the TPA member. The TPA member can have a U-shape including a bottom wall and two side walls extending from the bottom wall. Each of the two side walls can define a channel that is configured to receive a latching member. For example only, the plurality of latching members may comprise two matching pairs of latching members. The first pair may correspond with a pre-assembled position of the TPA member and the second pair may correspond with the fully-assembled position of the TPA member. In this manner, the TPA member can be coupled with the housing in the pre-assembled position, the electrical terminal can be inserted within the housing and locked by the primary locking member, and then the TPA member be moved to the fully-assembled position, as more fully described below.

In the fully-assembled position, the TPA member can inhibit movement of the primary locking member from the engaged condition. The TPA member may be in direct contact with the primary locking member and thereby inhibit movement of the primary locking member. For example only, in the examples described above where the primary locking member is a flexible retention arm that includes a ramp and a locking surface, the TPA member may be in direct contact with a back surface of the retention arm (opposite the ramp) and thereby inhibit the retention arm from flexing and disengaging from the corresponding feature on the electrical terminal.

The housing may also include a slide clip receiver that is configured to receive the slide clip such that the slide clip can be coupled with the housing. In some aspects, the slide clip receiver will be integrally formed on the housing and be configured to receive the slide clip only when the TPA member is in the fully-assembled position. For example only, when the TPA member is in the pre-assembled position the TPA member may block the slide clip receiver from coupling with the slide clip. When the TPA member is moved to the fully-assembled position, the slide clip receiver can become available (unblocked) to receive the slide clip, e.g., by slidingly receiving the slide clip.

In the above described implementations, insertion of the slide clip into the slide clip receiver may also constrain the TPA member between the housing and the slide clip so that the TPA member cannot be moved out of the fully-assembled position. In this manner, the slide clip may also provide an additional back-up locking functionality for the electrical terminal. Furthermore, in some configurations, the TPA member may include a clip lock member that fixedly couples with the slide clip in the assembled condition to inhibit removal of the slide clip from the assembled condition. In such configurations the slide clip may be directly coupled with both the housing and the TPA member to reinforce the direct coupling of the TPA member with the housing.

The electrical connector assembly described herein may provide an improved performance and ease of assembly over known connector assemblies, as will be apparent to those skilled in the art.

Figure 2:
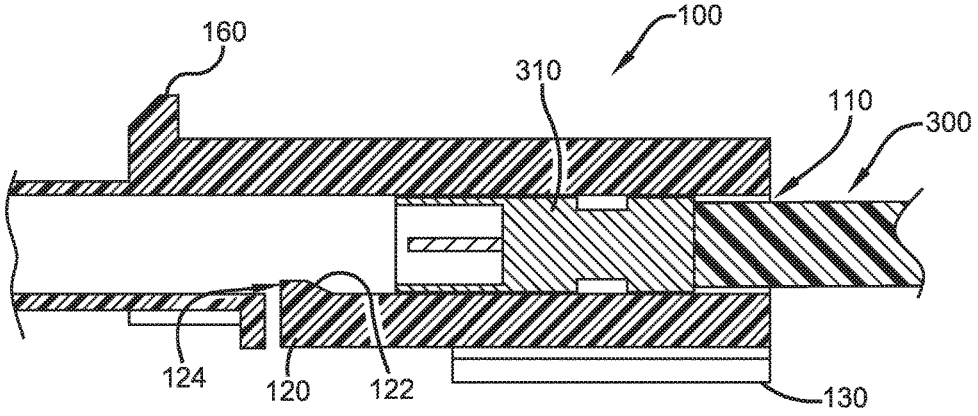
FIG. 2 is a partial sectional view of the electrical connector assembly of FIG. 1 showing an electrical terminal partially inserted therein.
Figure 3:
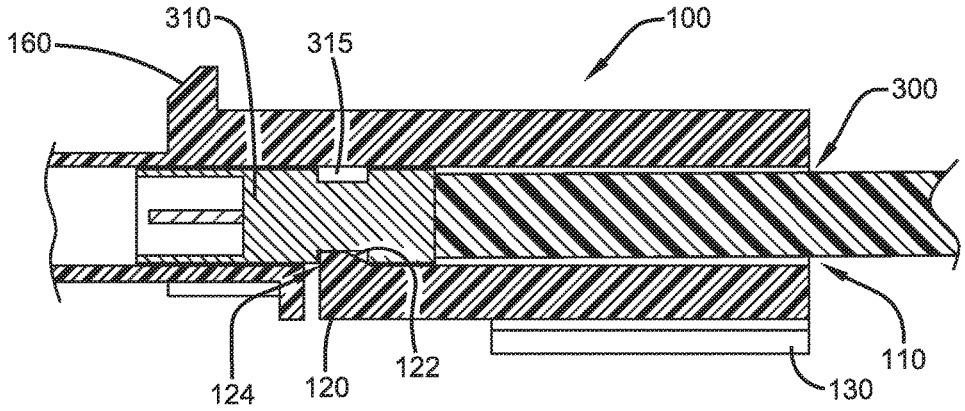
FIG. 3 is a partial sectional view of the electrical connector assembly of FIG. 1 showing an electrical terminal fully inserted therein.

Referring now to FIGS. 1-3, an example electrical connector assembly 10 is illustrated. The electrical connector assembly includes a housing 100 and a terminal position assurance (TPA) member 200. The electrical connector assembly 10 can be configured to receive an electrical terminal 300 in a terminal insertion cavity 110 formed within the housing 100. In FIG. 2 the electrical terminal 300 is shown in a partially inserted condition, whereas in FIG. 3 the electrical terminal 300 is shown in a fully inserted condition.

The housing 100 can include a primary locking member 120 that engages with the electrical terminal 300 when in the fully inserted condition. In the illustrated example, the primary locking member 120 comprises a flexible retention arm that includes a ramp 122 and a locking surface 124. It should be appreciated that the primary locking member 120 can take different forms and still be within the scope of the present disclosure. The housing 100 can further include a slide clip receiver 130 and a plurality of latching members 140. The slide clip receiver 130 configured to receive a slide clip 350 (not shown in FIGS. 2 and 3) as more fully described below.

Each of the latching members 140 can be configured to mate with a corresponding connecting portion 210 formed in or on the TPA member 200. In this manner, the plurality of latching members 140 can inhibit movement of the TPA member 200 in a disengagement direction D (see FIG. 6). In the illustrated example, the latching members 140 extend outwardly from the outside surface 105 of the housing 100 and are configured to mate with a connecting portion 210 in the form of a channel formed in the side walls 230 of the TPA member 200. It should be appreciated, however, that the latching members 140 and the connecting portion(s) 210 can take different forms and still be within the scope of the present disclosure. For example only, in an alternative implementation, the forms of the latching members 140 and connecting portions 210 can be switched such that the latching members 140 take the form of a plurality of channels, apertures, or openings formed in the housing 100 and the connecting portions 210 comprise a plurality of projections extending from the TPA member 200.

As briefly mentioned above, the TPA member 200 is configured for coupling with the housing 100, e.g., via the latching members 140. The illustrated TPA member 200 has a U-shape and includes a bottom wall 220 and two side walls 230 extending from the bottom wall 220. Further, each of the side walls 230 has a connecting portion 210 configured to mate with at least one of the plurality of latching members 140. As noted above, in the illustrated example the connecting portions 210 take the form of channels, although other forms are within the scope of the present disclosure.

FIGS. 2 and 3 illustrate the process by which the electrical terminal 300 is inserted within the housing 100 (e.g., within the terminal insertion cavity 110). As the electrical terminal 300 is inserted within the terminal insertion cavity 110, a connector 310 at the end of the electrical terminal 300 will interact with the ramp 122 to flex or deflect the primary locking member 120. Upon being fully inserted (FIG. 3), the retention arm 120 can return to its un-flexed position (engaged condition) and the locking surface 124 can cooperate with a corresponding feature 315 on the electrical terminal 300 to inhibit removal of the electrical terminal 300 from the cavity 110. In the illustrated example, the corresponding feature 315 comprises a channel or circular recess in the connector 310 that can interact with the primary locking member 120.

As briefly mentioned above, the slide clip 350 can be configured to couple with the housing 100 via the slide clip receiver 130. The slide clip receiver 130 can be integrally formed with the housing 100 in that the slide clip receiver 130 and housing 100 are one component and the slide clip receiver 130 forms an integrated component of the housing 100. For example only, the housing 100 and slide clip receiver 130 can be formed from one material (e.g., plastic) and cannot be separated without destruction or deformation. In the illustrated example, the slide clip receiver 130 can comprise two J-shaped slide rails 132 extending from a housing surface 107 of the housing 100. Further, the slide clip 350 can include an insertion portion 352 and a mounting projection 354, e.g., formed on opposing ends. The slide clip 350 can slidingly engage (e.g., slide into contact) with the slide clip receiver 130 by sliding the insertion portion 352 under the J-shaped slide rails 132. An aperture 356 defined in the insertion portion 352 can receive and engage with a locking projection 225 formed on the TPA member 200, as more fully described below, to securely fasten the slide clip 350 within the slide clip receiver 130.

Figure 4:
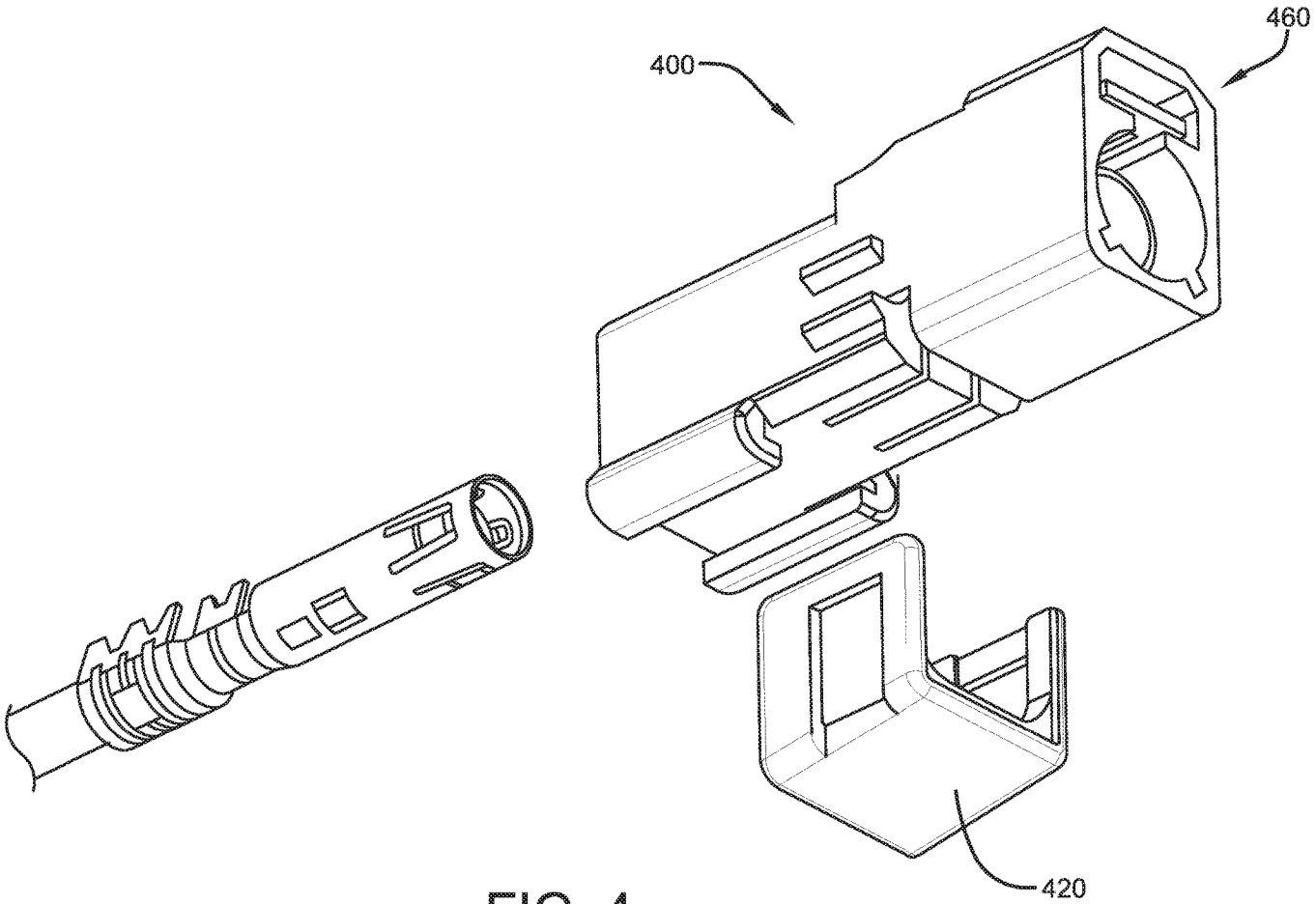
FIG. 4 is a perspective view of another example electrical connector assembly according to some implementations of the present disclosure.

The example electrical connector assembly 10 of FIG. 1 is a male connector and is illustrated in the deconstructed state where the housing 100, the TPA member 200, and the slide clip 350 are separate. An example female electrical connector assembly 400 is shown in FIG. 4. The electrical connector assembly 400 is substantially similar to the male electrical connector assembly 10 of FIG. 1. For the sake of brevity, components that are identical in both of the electrical connector assemblies 10, 400 will not be repeated here. Aside from taking the form of a female connector assembly, the electrical connector assembly 400 further differs from the electrical connector assembly 10 in that it does not include a slide clip (e.g., slide clip 350 of FIG. 1). Accordingly, the TPA member 420 of electrical connector assembly 400 also does not include a locking projection (e.g., locking projection 225 of FIG. 1).

The example male electrical connector assembly 10 and the example female electrical connector assembly 400 can be coupled together to electrically couple their corresponding electrical terminals 300. For example only, the electrical connector assemblies 10, 400 can be securely coupled together via a housing lock comprising housing lock components 160, 460 formed on the electrical connector assemblies 10, 400, respectively. The housing lock components 160, 460 may be constructed to be releasably secured to each other, although any form of housing lock can be included.

Figure 5:
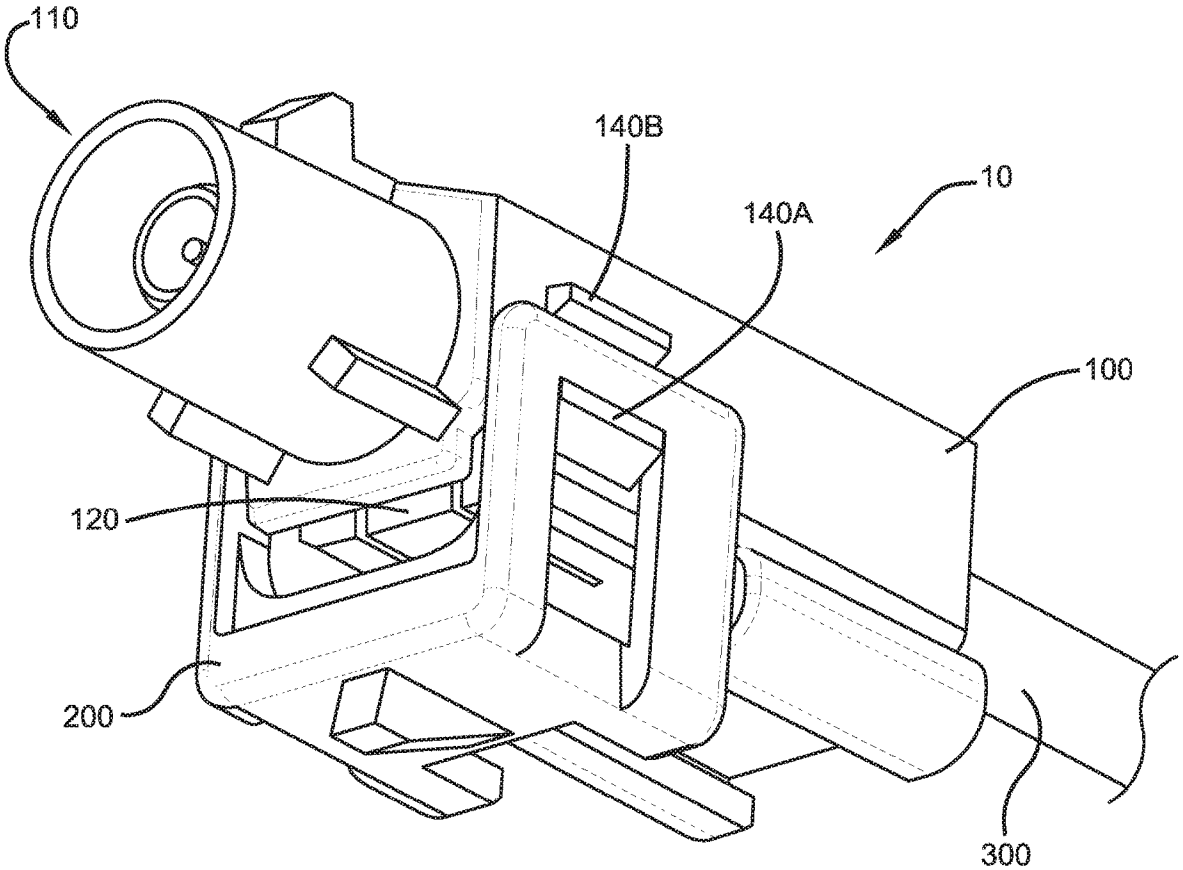
FIG. 5 is a perspective view of the electrical connector assembly of FIG. 1 shown in a pre-assembly condition.

With additional reference to FIG. 5, the example electrical connector assembly 10 of FIG. 1 is shown in a pre-assembly condition. In the illustrated pre-assembly condition, the electrical terminal 300 is shown as being fully inserted within the housing 100. For example only, the electrical terminal 300 is retained within the terminal insertion cavity 110 by the primary locking member 120 in what can be described as the engaged condition (see, e.g., FIG. 3).

In FIG. 5, the TPA member 200 is coupled to the housing 100 via latching members 140 in a pre-assembly position. More specifically, the plurality of latching members 140 formed on housing 100 comprises a first set 140A of two latching members 140 and a second set 1406 of two latching members 140. The first set 140A corresponds to a pre-assembly position of the TPA member 200 in that the TPA member 200, when coupled to the first set 140A, will be coupled to but not snugly arranged against the housing 100. The second set 140B corresponds to the assembled condition (see FIG. 6) in which the TPA member 200 is both coupled to and snugly arranged against the housing 100.

Figure 6:
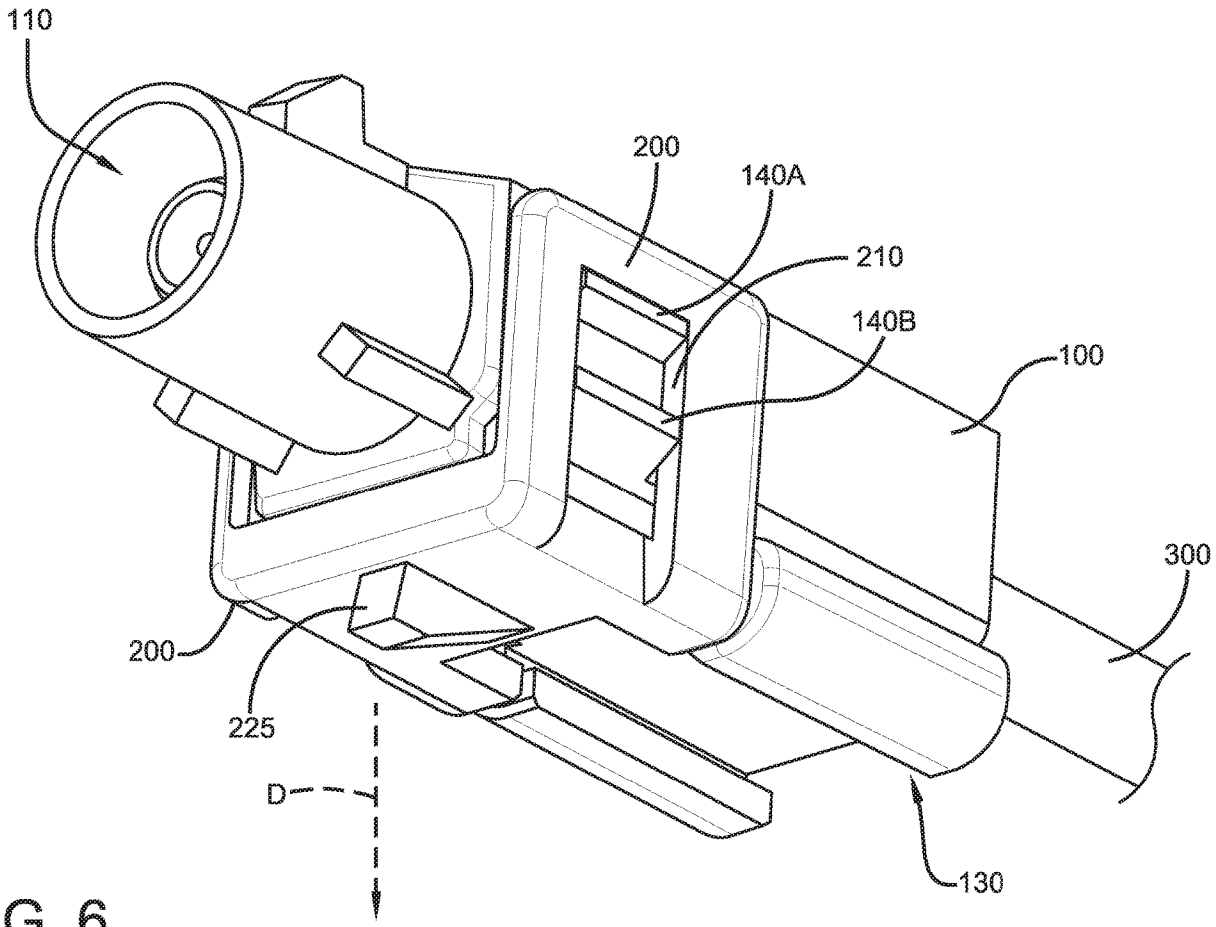
FIG. 6 is a perspective view of the electrical connector assembly of FIG. 1 shown in an assembled condition.

Referring now to FIG. 6, the example electrical connector assembly 10 is shown in the assembled condition. In the assembled condition, the electrical terminal 300 is shown as being fully inserted and retained within the housing 100 and the TPA member 200 is coupled to the housing 100 via the second set 140B of two latching members 140 to be snugly arranged against the housing 100. In this manner, the TPA member 200 can inhibit movement of the primary locking member 120 from the engaged condition. In the illustrated example, the TPA member 200 is in direct contact with the back surface of the retention arm (primary locking member 120) and thereby inhibits the retention arm from flexing and disengaging from the corresponding feature on the electrical terminal 300.

As mentioned above, the example female electrical connector assembly 400 shown in FIG. 4 can also be configured to be in the pre-assembly position. That is, the TPA member 420 can be coupled to a first set 140A of latching members 140 and the electrical terminal 300 can be fully inserted within the electrical connector assembly. The TPA member 420 of the example female electrical connector assembly 400 can function in the same manner as TPA member 200 described above.

With additional reference to FIG. 1, the bottom wall 220 of the TPA member 200 can have a flat surface 222. The flat surface 222 can provide the direct contact with the primary locking member 120 to inhibit movement of the primary locking member 120 from the engaged condition in the engaged condition. Furthermore, the TPA member 200 can have a complementary shape to the shape of the housing 100 such that the assembled housing 100/TPA member 200 can be low profile in order to reduce the size of the electrical connector assembly 10. For example only, in the assembled condition, the TPA member 200 can be seated within a recess 150 of the housing 10. Additionally or alternatively, the TPA member 200 can include a fillet 240 where each of the two side walls 230 meets with the bottom wall 220. In some embodiments, the recess 150 of the housing 100 can include a positioning crevice 152 corresponding to each of the fillets 240. The positioning crevices 152 may cooperate with the fillets 240 to maintain positioning of the TPA member 200 in the assembled condition. The fillets 240 may also provide an additional locking functionality by being in direct contact with the primary locking member 120 (e.g., at one end 126) to inhibit movement of the primary locking member 120 from the engaged condition.

Figure 7:
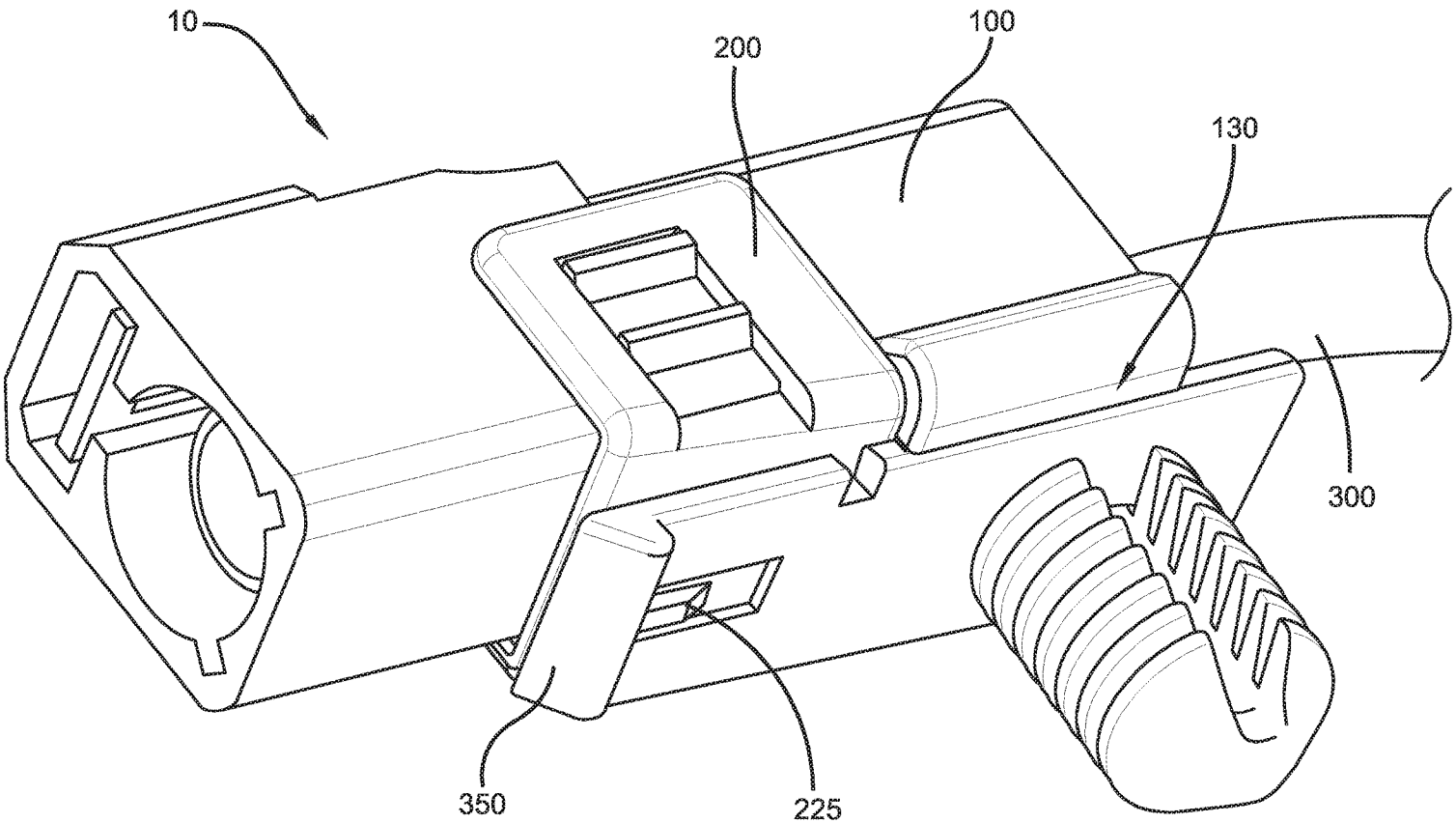
FIG. 7 is a perspective view of the electrical connector assembly of FIG. 1 shown in a fully-assembled condition.

Referring now to FIG. 7, the example electrical connector assembly 10 is shown in the fully assembled condition in which the housing 100, the TPA member 200, and the slide clip 350 are coupled together. As shown in FIG. 7, the slide clip 350 can be inserted/received within the slide clip receiver 130. As briefly mentioned above, insertion of the slide clip 350 into the slide clip receiver 130 may constrain the TPA member 200 between the housing 100 and the slide clip 350 so that the TPA member 200 cannot be moved out of the assembled position. In this manner, the slide clip 350 may also provide an additional back-up locking functionality for the electrical terminal 300. Furthermore, the TPA member 200 can include a clip lock member 225 that fixedly couples with the slide clip 350 in the assembled condition to inhibit removal of the slide clip 350. Accordingly, in the illustrated example the slide clip 350 is directly coupled with both the housing 100 and the TPA member 200 to reinforce the direct coupling of the TPA member 200 with the housing 100.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known procedures, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The term "and/or" includes any and all combinations of one or more of the associated listed items. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electrical connector assembly, comprising:

a housing comprising (i) at least one terminal insertion cavity for receiving an electrical terminal, (ii) a primary locking member that engages with the electrical terminal when the electrical terminal is inserted within the at least one terminal insertion cavity to retain the electrical terminal within the at least one terminal insertion cavity, (iii) a slide clip receiver, and (iv) a plurality of latching members;

a terminal position assurance (TPA) member for coupling with the housing via the plurality of latching members, the TPA member having a U-shape and including a bottom wall and two side walls extending from the bottom wall, each of the two side walls having a connecting portion configured to mate with at least one of the plurality of latching members; and a slide clip for coupling with the housing via the slide clip receiver, wherein in an assembled condition:

the electrical terminal is retained within the at least one terminal insertion cavity by the primary locking member in an engaged condition, the TPA member is fixedly coupled to the housing via the plurality of latching members cooperating with the connecting portions, the plurality of latching members inhibiting movement of the TPA member in a disengagement direction, the TPA member inhibits movement of the primary locking member from the engaged condition, and the slide clip is coupled with the slide clip receiver such that the TPA member is constrained between the housing and the slide clip to inhibit movement of the TPA member in the disengagement direction; and wherein the bottom wall of the TPA member has a flat surface, the flat surface being in contact with the primary locking member to inhibit movement of the primary locking member from the engaged condition.

2. The electrical connector assembly of claim 1, wherein the TPA member further includes a clip lock member, the clip lock member fixedly coupling with the slide clip in the assembled condition and inhibiting removal of the slide clip from the assembled condition.

3. The electrical connector assembly of claim 1, wherein the TPA member includes a fillet where each of the two side walls meets with the bottom wall.

4. The electrical connector assembly of claim 3, wherein, in the assembled condition, the TPA member is seated within a recess of the housing.

5. The electrical connector assembly of claim 4, wherein the recess of the housing includes a positioning crevice corresponding to each of the fillets, the crevices cooperating with the fillets to maintain positioning of the TPA member in the assembled condition.

6. The electrical connector assembly of claim 1, wherein the slide receiver comprises two J-shaped slide rails extending from a housing surface of the housing, wherein the slide clip slidingly engages with the two slide rails.

7. The electrical connector assembly of claim 1, wherein the plurality of latching members comprises a first set of two latching members and a second set of two latching members, wherein the first set corresponds to a pre-assembly position of the TPA member and the second set corresponds to the assembled condition.

8. The electrical connector assembly of claim 1, wherein, in the assembled condition, the TPA member is seated within a recess of the housing.

9. The electrical connector assembly of claim 1, wherein the plurality of latching members extend outwardly from an outside surface of the housing and the connecting portions comprises channels defined by the side walls, each channel being configured to receive a corresponding latching member.

10. The electrical connector assembly of claim 1, wherein the plurality of first latching members extend outwardly from an outside surface of the first housing and the first connecting portions comprises channels defined by the side walls, each channel being configured to receive a corresponding first latching member.

11. The electrical connector assembly of claim 1, wherein the first housing is securely coupled with the second housing via a housing lock.

12. An electrical connector assembly, comprising:

a first electrical terminal;

a second electrical terminal;

a first housing comprising (i) at least one first terminal insertion cavity for receiving the first electrical terminal, (ii) a first primary locking member that extends along a base of the first housing and engages with the first electrical terminal when the first electrical terminal is inserted within the at least one first terminal insertion cavity to retain the first electrical terminal within the at least one first terminal insertion cavity, (iii) a first slide clip receiver, and (iv) a plurality of first latching members;

a second housing comprising (i) at least one second terminal insertion cavity for receiving the second electrical terminal, (ii) a second primary locking member that extends along a base of the second housing and engages with the second electrical terminal when the second electrical terminal is inserted within the at least one second terminal insertion cavity to retain the second electrical terminal within the at least one second terminal insertion cavity, (iii) a second slide clip receiver, and (iv) a plurality of second latching members;

a first terminal position assurance (TPA) member for coupling with the first housing via the plurality of first latching members, the first TPA member having a U-shape and including a bottom wall and two side walls extending from the bottom wall, each of the two side walls having a first connecting portion configured to mate with at least one of the plurality of first latching members;

a second terminal position assurance (TPA) member for coupling with the second housing via the plurality of second latching members, the second TPA member having a U-shape and including a bottom wall and two side walls extending from the bottom wall, each of the two side walls having a second connecting portion configured to mate with at least one of the plurality of second latching members; and a first slide clip for coupling with the first housing via the first slide clip receiver; and a second slide clip for coupling with the second housing via the second slide clip receiver;

wherein in an assembled condition:

the first electrical terminal is retained within the at least one first terminal insertion cavity by the first primary locking member in an engaged condition, the second electrical terminal is retained within the at least one second terminal insertion cavity by the second primary locking member in an engaged condition, the first TPA member is fixedly coupled to the first housing via the plurality of first latching members cooperating with the first connecting portions, the plurality of first latching members inhibiting movement of the first TPA member in a disengagement direction, the second TPA member is fixedly coupled to the second housing via the plurality of second latching members cooperating with the second connecting portions, the plurality of second latching members inhibiting movement of the second TPA member in the disengagement direction, the first TPA member inhibits movement of the first primary locking member from the engaged condition, the second TPA member inhibits movement of the second primary locking member from the engaged condition, the first slide clip is coupled with the first slide clip receiver such that the first TPA member is constrained between the first housing and the first slide clip to inhibit movement of the first TPA member in the disengagement direction, the second slide clip is coupled with the second slide clip receiver such that the second TPA member is constrained between the second housing and the second slide clip to inhibit movement of the second TPA member in the disengagement direction, and the first housing is coupled with the second housing such that the first electrical terminal is coupled with the second electrical terminal.

13. The electrical connector assembly of claim 12, wherein the first TPA member further includes a clip lock member, the clip lock member fixedly coupling with the first slide clip in the assembled condition and inhibiting removal of the first slide clip from the assembled condition.

14. The electrical connector assembly of claim 12, wherein the bottom wall of the first TPA member has a flat surface, the flat surface being in contact with the first primary locking member to inhibit movement of the first primary locking member from the engaged condition.

15. The electrical connector assembly of claim 14, wherein the first TPA member includes a fillet where each of the two side walls meets with the bottom wall.

16. The electrical connector assembly of claim 15, wherein, in the assembled condition, the first TPA member is seated within a recess of the first housing.

17. The electrical connector assembly of claim 16, wherein the recess of the first housing includes a positioning crevice corresponding to each of the fillets, the crevices cooperating with the fillets to maintain positioning of the first TPA member in the assembled condition.

18. The electrical connector assembly of claim 12, wherein the first slide receiver comprises two J-shaped slide rails extending from a housing surface of the first housing, wherein the first slide clip slidingly engages with the two slide rails.

19. The electrical connector assembly of claim 12, wherein the plurality of first latching members comprises a first set of two latching members and a second set of two latching members, wherein the first set corresponds to a pre-assembly position of the first TPA member and the second set corresponds to the assembled condition.

* * * * *